US008408790B2

(12) United States Patent
Reilly

(10) Patent No.: US 8,408,790 B2
(45) Date of Patent: Apr. 2, 2013

(54) LIQUID PACKAGE AND USES THEREOF

(76) Inventor: Bill Reilly, Newmarket (CA)

( * ) Notice: Subject to any disclaimer, the term of this patent is extended or adjusted under 35 U.S.C. 154(b) by 249 days.

(21) Appl. No.: 12/905,533

(22) Filed: Oct. 15, 2010

(65) Prior Publication Data

US 2011/0103716 A1 May 5, 2011

Related U.S. Application Data

(60) Provisional application No. 61/251,761, filed on Oct. 15, 2009.

(51) Int. Cl.

| | |
|---|---|
| ***B65D 33/00*** | (2006.01) |
| ***B65D 33/10*** | (2006.01) |
| ***B65D 33/16*** | (2006.01) |
| ***B65D 33/01*** | (2006.01) |
| ***B65D 30/16*** | (2006.01) |

(52) U.S. Cl. ..... 383/41; 383/10; 383/63; 383/64; 383/100; 383/104; 383/906

(58) Field of Classification Search ..... 383/63, 383/64, 906, 100, 101, 103, 104, 66, 41, 383/10

See application file for complete search history.

(56) References Cited

U.S. PATENT DOCUMENTS

| | | | | |
|---|---|---|---|---|
| 3,149,772 | A * | 9/1964 | Olsson | 383/103 |
| 3,528,600 | A * | 9/1970 | White | 383/9 |
| 4,470,152 | A * | 9/1984 | Blankenship | 383/37 |
| 5,419,638 | A * | 5/1995 | Jamison | 383/100 |
| 6,076,967 | A * | 6/2000 | Beaudette | 383/41 |
| 6,176,394 | B1 * | 1/2001 | Shimko et al. | 222/92 |
| 6,352,365 | B1 * | 3/2002 | Healy et al. | 383/209 |
| 6,883,683 | B1 * | 4/2005 | Cunningham et al. | 222/107 |
| 6,945,392 | B2 * | 9/2005 | Furukawa et al. | 206/213.1 |
| 7,007,825 | B2 | 3/2006 | Crosland et al. | |
| 2002/0154835 | A1 * | 10/2002 | Galomb | 383/10 |
| 2006/0008187 | A1 * | 1/2006 | Armstrong | 383/103 |
| 2009/0097779 | A1 * | 4/2009 | Branch | 383/5 |
| 2010/0072224 | A1 * | 3/2010 | Ha | 222/107 |

FOREIGN PATENT DOCUMENTS

| | | | |
|---|---|---|---|
| EP | 71365 | A2 * | 2/1983 |
| EP | 678574 | A2 * | 10/1995 |
| JP | 2005289452 | A * | 10/2005 |
| JP | 2006232367 | A * | 9/2006 |
| JP | 2007269322 | A * | 10/2007 |
| JP | 2007269330 | A * | 10/2007 |
| JP | 2007314245 | A * | 12/2007 |

* cited by examiner

*Primary Examiner* — Jes F Pascua
(74) *Attorney, Agent, or Firm* — Dickinson Wright PLLC

(57) ABSTRACT

Apparatus is disclosed for packaging a beverage component of a prepared meal having a hot food component. The meal is of the type that is purchased on a take-away or delivery basis for consumption, after transport to a dining destination and before the food component gets cold. This apparatus comprises: a pouch which defines an opening for receiving said beverage; and a spigot connected to said pouch for dispensing said beverage therefrom. The apparatus can also include means for sealing said opening to define a container and for releasing gas from said container such that, in normal use, said container remains sealed during said transport and such that, in normal use with a carbonated beverage, the carbonated beverage does not go flat before the food component gets cold. The sealing means can comprise a press-to-seal closure for sealing said opening and a labyrinth channel to vent said container.

20 Claims, 6 Drawing Sheets

LIQUID PACKAGE AND USES THEREOF

CROSS-REFERENCE TO RELATED APPLICATIONS

This application is related to, and claims the benefit of priority from, U.S. Provisional Application Ser. No. 61/251,761, filed 15 Oct. 2009, the disclosure of which application is incorporated herein by reference in its entirety.

FIELD

The invention relates generally to the restaurant industry.

BACKGROUND

In the restaurant industry, it is well-known to sell beverages in disposable cups which are filled on-site from a soda fountain or similar bulk dispenser. Beverages are also sold in commercially-available single and multiple-use serving sizes, such as cans and bottles. It is also known for restaurants to sell beverages in bulk. One known bulk delivery technology includes a bag having a combination screw-cap closure/spigot for filling and dispensing and a box in which the bag is supported for transport. This product is known to be used for non-carbonated beverages such as coffee and lemonade.

SUMMARY OF THE INVENTION

Package apparatus for use with a liquid forms one aspect of the invention. This apparatus comprises: a pouch, the pouch defining an opening for receiving said liquid and having a closure for sealing the opening to define a container, the closure being selected from the group consisting of press-to-close and slider closures; and a spigot connected to the pouch to communicate with the interior of the container.

According to one aspect of the invention, the package apparatus can further comprise an apparatus adapted to vent said container at least before the pressure in the container exceeds the sealing capacity of the closure.

According to another aspect of the invention, the apparatus adapted to vent said container can be a one-way valve.

According to another aspect of the invention, the apparatus adapted to vent said container can be a labyrinth channel.

According to another aspect of the invention, the pouch can be a stand-up pouch.

According to another aspect of the invention, the closure can be a press-to-close closure.

According to another aspect of the invention, the closure can be a slider closure.

According to another aspect of the invention, the pouch can have a carrying handle.

According to another aspect of the invention, the pouch can have a stand-up orientation and the closure can be a resealable closure, and, in the stand-up orientation of the pouch, the spigot can communicate with the bottom of the container and the apparatus adapted to vent said container can communicate with the top of the container.

According to another aspect of the invention, the pouch can be defined by a pair of films having portions which are sealed together and the labyrinth channel can be defined by portions of the pair of films which are not sealed together.

According to another aspect of the invention, the labyrinth channel can have at least 6 u-bends.

According to another aspect of the invention, the closure can be on one of the pair of films.

According to another aspect of the invention, the pouch can further have a carrying handle which is adapted to permit the liquid to be transported by carriage of the pouch by the handle.

According to another aspect of the invention, the carrying handle can be defined by a cut-out in the pair of films.

According to another aspect of the invention, the package apparatus can be shipped sealed, in a sanitary condition.

Forming other aspects of the invention are various uses.

In one such possible use, the pouch can be filled with a beverage from a beverage fountain to form a filled pouch and the filled pouch can be sealed with the closure to contain the beverage.

In another such possible use, the closure can be unsealed to open the pouch; the pouch can be filled with carbonated beverage from a beverage fountain at a restaurant to form a filled pouch; and the filled pouch can be sealed with the closure to contain the beverage.

Forming another aspect of the invention is a package apparatus for packaging a carbonated beverage component of a prepared meal having a hot food component, said meal being of the type that is purchased on a take-away or delivery basis for consumption, after transport to a dining destination and before the food component gets cold. This package apparatus comprises: a pouch which defines an opening for receiving said beverage; a spigot connected to said pouch for dispensing said beverage therefrom; and means for sealing said opening to define a container and for releasing gas from said container such that, in normal use, said container remains sealed during said transport and such that, in normal use, said carbonated beverage does not go flat before the food component gets cold.

According to another aspect, the means for sealing said opening to define a container and for releasing gas from said container can comprise: a closure for sealing said opening; and apparatus adapted to vent said container.

According to other aspects of the invention, the closure can be selected from a press-to-close closure and a slider closure and the apparatus adapted to vent said container can be a labyrinth seal.

The package apparatus of the present invention can be relatively leak-proof, relatively inexpensive and can be filled relatively quickly and relatively easily. This allows for their deployment as, for example, take-out containers in fast-food restaurants, which can reduce costs associated with packaging and transport.

Other advantages, features and characteristics of the present invention will become more apparent upon consideration of the following detailed description and the appended claims with reference to the accompanying drawings, the latter being briefly described hereinafter.

DETAILED DESCRIPTION

Figure 1:
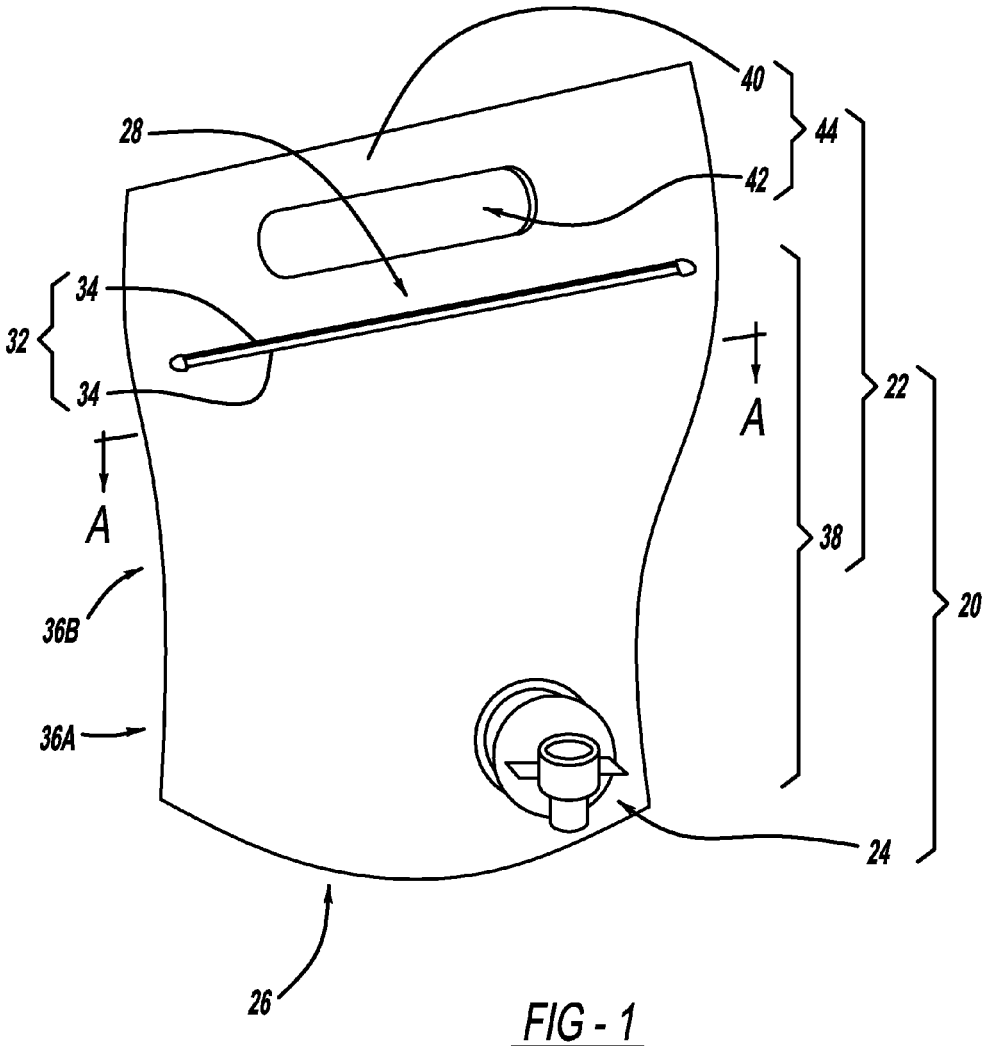
FIG. 1 is a front perspective view of a package apparatus according to an exemplary embodiment of the invention.
Figure 2:
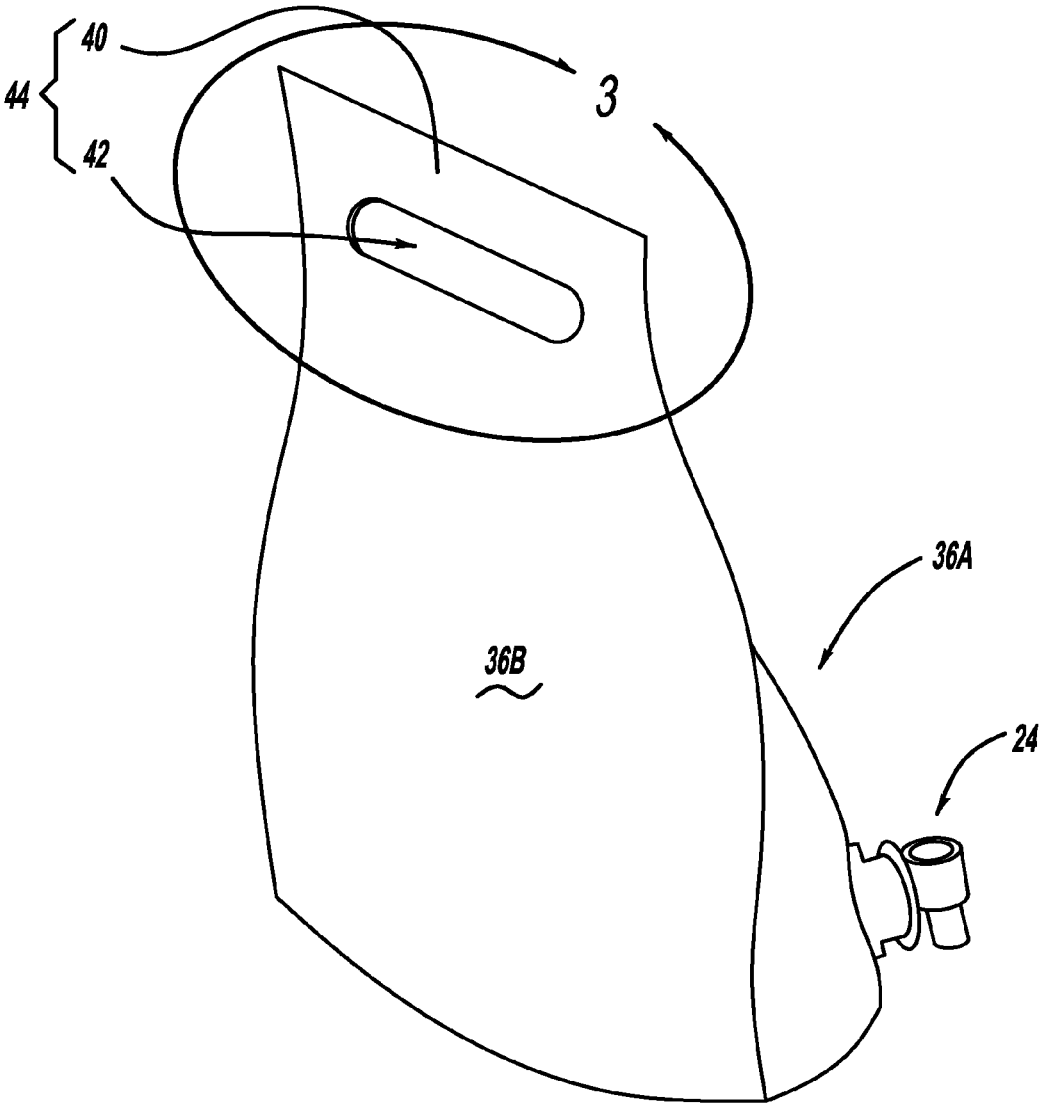
FIG. 2 is a rear perspective view of the package apparatus of FIG. 1.

Package apparatus 20 according to an exemplary embodiment of the invention is illustrated in FIGS. 1 and 2 and will be seen to include a pouch 22 and a spigot 24.

The pouch 22 is of the type known in the packaging industry as a stand-up resealable pouch. It is formed by panels 36A and 36B which are sealed together in a conventional manner. It has a gussetted base 26 that allows the pouch 22 to stand upright. An opening 28 is defined in the pouch 22 and has a press-to-close resealable closure 32. The closure 32 includes cooperating plastic ribs 34 defined on the panel 36A of the pouch 22, which, when pressed together, interlock, to form a liquid-tight seal. This seals the pouch 22 to form a liquid-tight container 38 that contains any liquid held therewithin. The panels 36A and 36B of the pouch 22 also have a manually-grippable portion 40 and a cut-out 42 which project beyond the closure to form a manually-grippable carrying handle 44 that defines the top of the pouch 22.

The spigot 24 is secured in a conventional manner to the pouch 22, adjacent to the base 26, to permit dispensing of the contents of the liquid contents of pouch 22.

Figure 3:
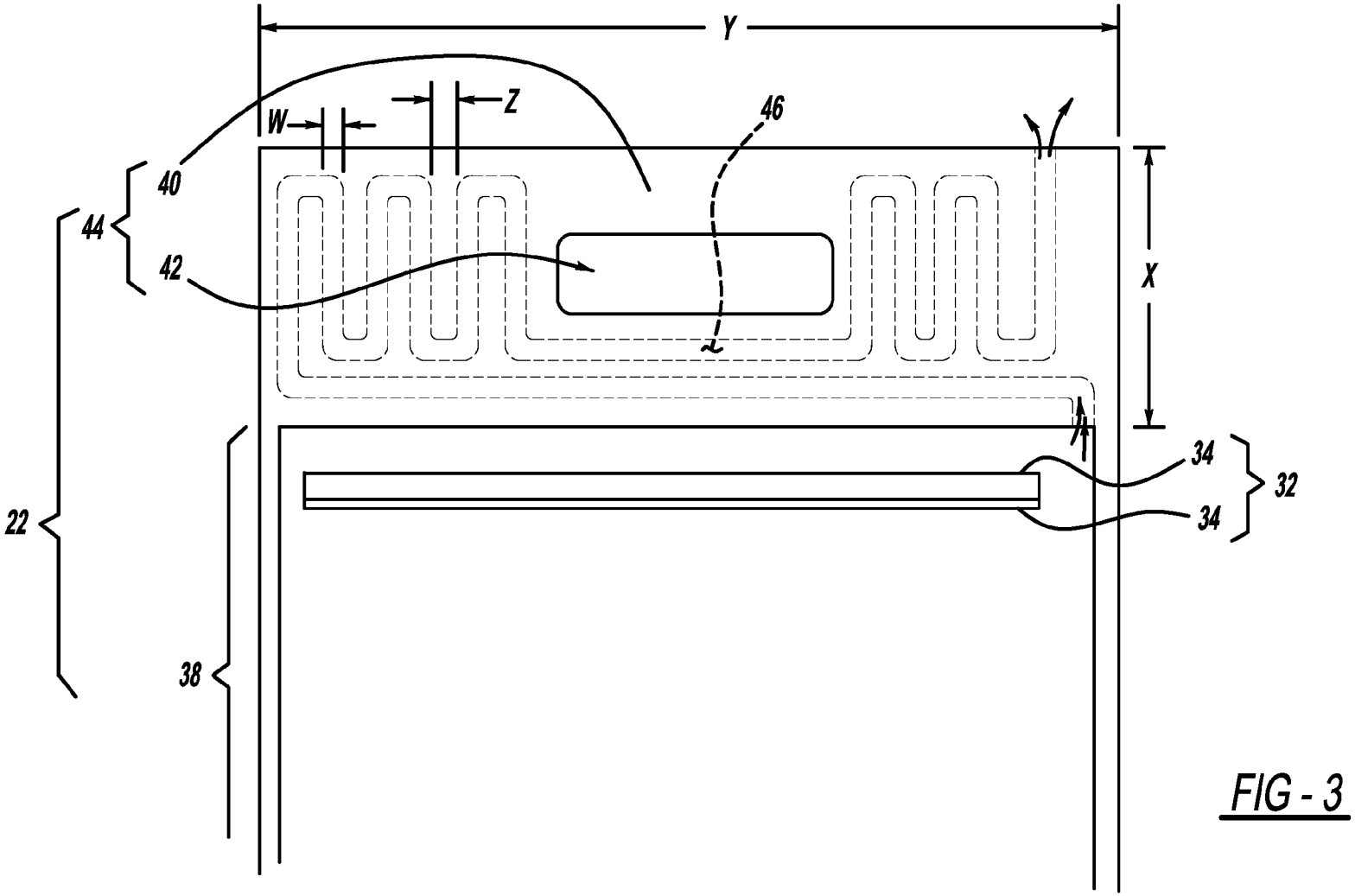
FIG. 3 is a front elevational view of the encircled area 3 of FIG. 2.
Figure 4:
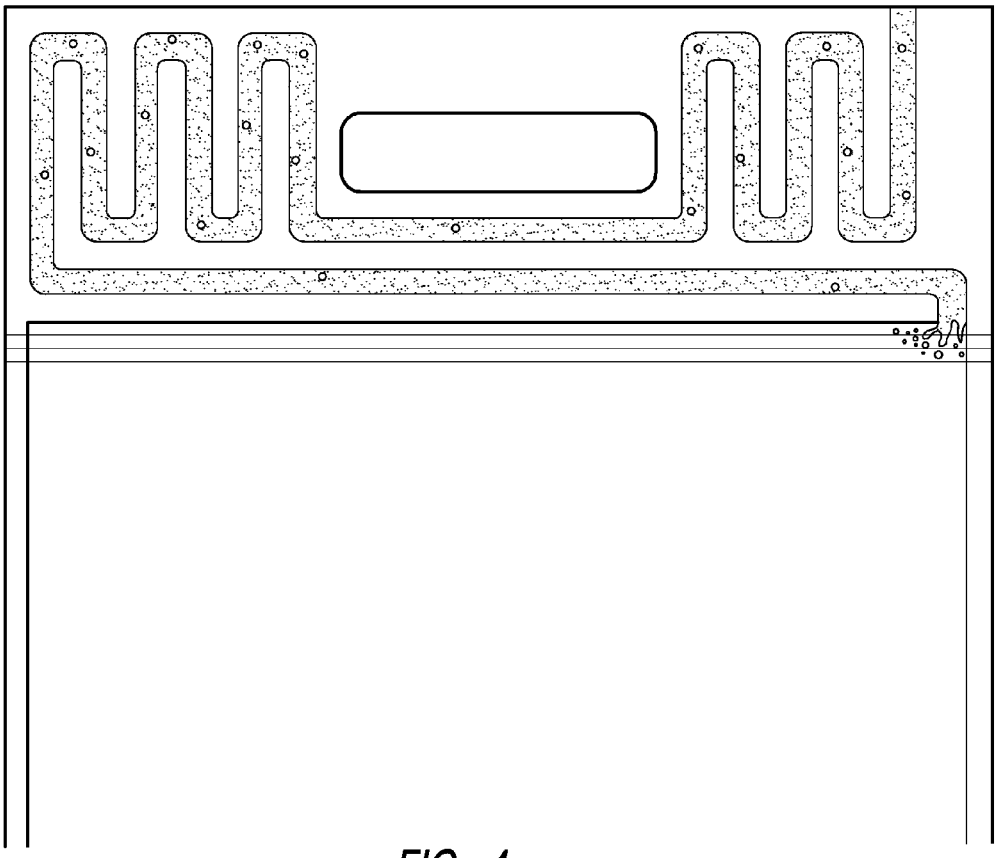
FIG. 4 is a view similar to FIG. 3 but drawn to scale.
Figure 5:
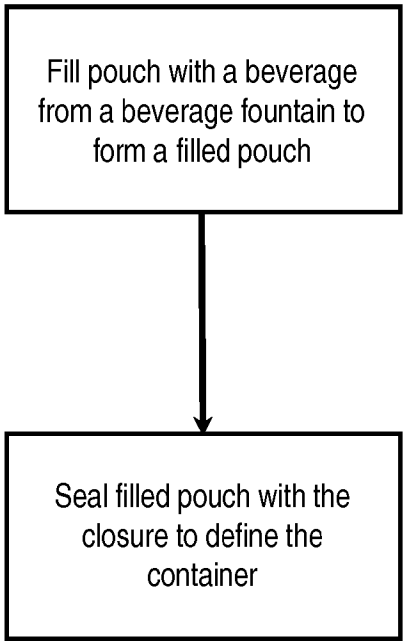
FIG. 5 shows the steps of one possible method of use of the package apparatus of the invention.
Figure 6:
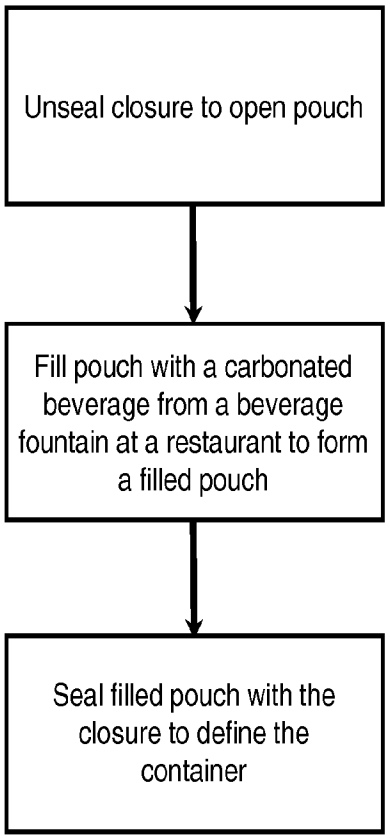
FIG. 6 shows the steps of another possible method of use of the package apparatus of the invention.

A labyrinth channel 46 according to the exemplary embodiment is illustrated in phantom lines in FIG. 3 and will be seen to have ten (10) u-bends. The labyrinth channel 46 is defined between the panels 36A and 36B and is formed by sealing, using heat sealing, sonic welding, adhesive bonding or the like, the panels 36A and 36B, such that there are sealed and unsealed portions at the top of the pouch 22. The unsealed portions of the panels 36A and 36B define the labyrinth channel 46 which vents the container 38 to the atmosphere.

This package apparatus 20 can, for example, be shipped in quantities to a fast-food restaurant, with the container portion 38 sealed by the closure 32 and in a sanitized condition. When an order is placed for a multiple-serving quantity of beverage, an operator at the restaurant retrieves one of the pouches, unseals the closure and fills the container through the opening from, for example, a soda fountain, to form a filled pouch. When the container has been filled with the desired quantity of beverage, the closure is sealed to form a container and the now-filled container package is handed to the customer as part of the transaction. The customer can easily transport the beverage via the handle and, at a desired time and location, dispense the beverage through the spigot.

It is known that a carbonated beverage effervesces at atmospheric pressure. This will occur naturally. However, agitating the carbonated beverage increases the rate of effervescence. Generally, where a carbonated beverage is poured at atmospheric pressure into a container which is subsequently closed, the effervescing carbon dioxide will increase the pressure of the closed container.

Accordingly, during normal use of the package, carbon dioxide will be released into the head space of the container. Moreover, transportation of the pouch will generally agitate the carbonated beverage, increasing the rate at which carbon dioxide is released into the head space of the container. In an unvented pouch, this will cause pressure to build inside the container, which can cause a number of problems, namely, causing the closure or pouch to burst open or the liquid to pour excessively fast from the spigot. By providing a vent, the present invention allows pressure be released to the atmosphere from the container, avoiding the aforementioned problems.

However, while venting a container to the atmosphere allows gas to escape and equalizes pressure differences between the container and the atmosphere, it introduces the problem of leakage and also poses the potential for a "flat" (uncarbonated) beverage. By providing a labyrinth channel, namely, a long, tortuous passage, to provide venting, the present invention is less susceptible to liquid leakage than if it had a short, straight passage. Further, the inventors of the present invention have discovered that, when used with a carbonated beverage, a labyrinth channel with at least six u-bends can provide a channel that is relatively resistant to liquid leaks, provides resistance to gas flow that gives a relatively long shelf-life to the carbonated beverage (i.e. before the beverage goes flat) and provides a path for gas release that renders the package relatively unlikely to burst open.

An embodiment of the invention that is known to be useful can be characterized with reference to FIG. 3. In the context of a package for carrying 1 litre of liquid, the web width Y is 9.5", the cut-off length X is 3", the width of the labyrinth channel W is about 7.15 mm and the distance between U-bends Z is about 6.35 mm.

Of course, the person of ordinary skill will appreciate that the configuration of the apparatus adapted to vent the container will vary with, inter alia, the size of the pouch, the type of closure used and the condition in which the apparatus is to be used.

For example, when the apparatus will be used by a patron of a restaurant with a take-out meal, the carbonation need only be maintained in the carbonated beverage from the time the meal is picked-up to the time the meal is consumed, which, in view of the desirability of any hot food component of the meal to be consumed while warm, will normally be a relatively short time. Accordingly, the apparatus will be configured taking into account the period of time in which carbonation must be maintained, while keeping in mind that sufficient pressure must be relieved during the normal handling of the apparatus to avoid the pouch from bursting open. The manner of transport can also be considered. For example, if the package is to be used for take-away purposes, it will need to be relatively robust, to account for possible rough handling by customers in transport. In contrast, if the package is to be used only, for example, in a hotel, for room service delivery, a somewhat less robust package might be deemed sufficient. Further, the amount of carbonation may also be varied, and adjustments may be desirable to account for this. For example, the restaurant operator in a rural neighborhood, wherein the package would typically travel relatively long distances in comparison to an urban restauranteur, might increase the carbonation in the dispenser, and make the package more robust.

Further, whereas a press-to-close resealable closure is described, other closures, such as, for example, slider-type closures can be used. As well, whereas the press-to-close closure illustrated is of the type having interlocking ribs, any suitable press-to-close closure [such as, for example, an adhesive closure, wherein the adhesive is brought into operative contact by pressure along the seal] could be incorporated.

As well, whereas a resealable closure is specified, this is not necessary. The closure could, for example, be adapted so as to create a permanent seal. In this event, if it was desired to ship the closure in a sanitary condition, a tear strip or the like might be used, to temporarily seal the container during transport, and which could be removed at the time of filling.

Further, whereas a specific type of spigot and pouch is shown, it should be understood that spigots and bags of various styles could be used.

Additionally, whereas a handle provides advantage for the purpose of transport, it could be omitted.

Similarly, whereas a stand-up pouch is shown, this is not strictly necessary; dispensing could, for example, be easily accommodated by suspending the bag via the handle from a wall-mounted hook or the like. A manually-grippable handle similarly is not required to permit hanging; any small aperture could suffice, and this could potentially be created by the user as required, rather than pre-formed.

Moreover, whereas the labyrinth channel is described as being defined by the unsealed portions of the panels, it should be understood that labyrinth channels of various styles could be employed. The labyrinth channel could, for example, be in the form of a plastic tube, a molded piece of plastic or the like.

Likewise, whereas the vent is described as a labyrinth channel, it could also be a one-way valve. The one-way valve should open at least before the pressure differential between the container and the atmosphere exceeds the capacity of the package, to avoid failure. Selecting a lower pressure differential at which the valve will open reduces the risk that the seal will fail, but also increases the rate of decarbonation of a carbonated beverage. The same considerations apply when sizing the labyrinth, if used.

Finally, but without limitation, whereas usefulness in fast-food restaurants is indicated, this is not strictly required. The package apparatus could also, for example, be used for the sale of beverages, or other liquids to be dispensed, in convenience stores or the like.

Accordingly, the invention should be understood as limited only by the accompanying claims, purposively construed.

The invention claimed is:

1. Package apparatus for use with a liquid, said package apparatus comprising:

a pouch, the pouch defining an opening for receiving said liquid and having a closure for sealing said opening to define a container, the closure being selected from the group consisting of press-to-close and slider closures;

a spigot connected to said pouch to communicate with the interior of the container;

a labyrinth channel adapted to vent said container at least before the pressure in the container exceeds the sealing capacity of the closure, the labyrinth channel having at least 6 u-bends.

2. Package apparatus according to claim 1, wherein the apparatus adapted to vent said container is a one-way valve.

3. Package apparatus according to claim 1, wherein the apparatus adapted to vent said container is a labyrinth channel.

4. Package apparatus according to claim 3, wherein the pouch is a stand-up pouch.

5. Package apparatus according to claim 3, wherein the closure is a press-to-close closure.

6. Package apparatus according to claim 3, wherein the closure is a slider closure.

7. Package apparatus according to claim 3, wherein the pouch has a carrying handle.

8. Package apparatus according to claim 1, wherein:

the pouch has a stand-up orientation; the closure is a resealable closure; and, in the stand-up orientation of the pouch, the spigot communicates with the bottom of the container and the apparatus adapted to vent said container communicates with the top of the container.

9. Package apparatus according to claim 8, wherein: the pouch is defined by a pair of films having portions which are sealed together; and the labyrinth channel is defined by portions of the pair of films which are not sealed together.

10. Package apparatus according to claim 9, wherein the closure is on one of the pair of films.

11. Package apparatus according to claim 10, wherein the pouch further has a carrying handle which is adapted to permit said liquid to be transported by carriage of the pouch by the handle.

12. Package apparatus according to claim 11, wherein the carrying handle is defined by a cut-out in the pair of films.

13. Package apparatus according to claim 12, wherein the pouch is a stand-up pouch.

14. Package apparatus according to claim 8, wherein the package apparatus is shipped sealed, in a sanitary condition.

15. Use of the package apparatus of claim 8, characterized in that: the closure is unsealed to open the pouch; the pouch is filled with carbonated beverage from a beverage fountain at a restaurant to form a filled pouch; and the filled pouch is sealed with the closure to define the container.

16. Use of the package apparatus of claim 1, characterized in that: the pouch is filled with a beverage from a beverage fountain to form a filled pouch; and the filled pouch is sealed with the closure to define the container.

17. Package apparatus for packaging a carbonated beverage component of a prepared meal having a hot food component, said meal being of the type that is purchased on a take-away or delivery basis for consumption, after transport to a dining destination and before the food component gets cold, the package apparatus comprising:

a pouch which defines an opening for receiving said beverage;

a spigot connected to said pouch for dispensing said beverage therefrom;

means for sealing said opening to define a container and for releasing gas from said container such that, in normal use, said container remains sealed during said transport and such that, in normal use, said carbonated beverage does not go flat before the food component gets cold; and a labyrinth channel adapted to vent said container at least before the pressure in the container exceeds the sealing capacity of the closure, the labyrinth channel having at least 6 u-bends.

18. Package apparatus according to claim 17, wherein the means for sealing said opening to define a container and for releasing gas from said container comprises: a closure for sealing said opening; and apparatus adapted to vent said container.

19. Package apparatus according to claim 18, wherein the closure is selected from a press-to-close closure and a slider closure.

20. Package apparatus according to claim 19, wherein the apparatus adapted to vent said container is a labyrinth seal.

* * * * *